US011324335B2

(12) United States Patent
Huang et al.

(10) Patent No.: US 11,324,335 B2
(45) Date of Patent: May 10, 2022

(54) INFLATABLE PRODUCT WITH BREATHABLE USER INTERFACE

(71) Applicant: Intex Marketing Ltd., Tortola (VG)

(72) Inventors: ZhiXiong Huang, Fujian (CN); Huaitian Wang, Fujian (CN); Yaw Yuan Hsu, Fujian (CN)

(73) Assignee: INTEX MARKETING LTD., Tortola (VG)

( * ) Notice: Subject to any disclaimer, the term of this patent is extended or adjusted under 35 U.S.C. 154(b) by 194 days.

(21) Appl. No.: 16/622,735

(22) PCT Filed: Jun. 22, 2018

(86) PCT No.: PCT/IB2018/054638
§ 371 (c)(1),
(2) Date: Dec. 13, 2019

(87) PCT Pub. No.: WO2018/235057
PCT Pub. Date: Dec. 27, 2018

(65) Prior Publication Data

US 2020/0100598 A1 Apr. 2, 2020

(30) Foreign Application Priority Data

Jun. 22, 2017 (CN) ..... 201720732602.5

(51) Int. Cl.
*A47C 27/08* (2006.01)
*A47C 27/00* (2006.01)

(52) U.S. Cl.
CPC ..... *A47C 27/081* (2013.01); *A47C 27/006* (2013.01); *A47C 27/087* (2013.01)

(58) Field of Classification Search
CPC ..... A47C 27/08; A47C 27/081; A47C 27/006; A47C 27/087
See application file for complete search history.

(56) References Cited

U.S. PATENT DOCUMENTS 6,966,090 B2 * 11/2005 McClintock ..... A47C 21/022 5/502
2003/0188388 A1 * 10/2003 Boso ..... A47C 27/087 5/710

(Continued)

FOREIGN PATENT DOCUMENTS

CN 2930467 8/2007
CN 201076239 6/2008

(Continued)

OTHER PUBLICATIONS

International Search Report and Written Opinion for PCT/IB2018/054638 dated Oct. 31, 2018, 4 pages.

*Primary Examiner* — Fredrick C Conley
(74) *Attorney, Agent, or Firm* — Faegre Drinker Biddle & Reath LLP

(57) ABSTRACT

An inflatable furniture design has a user-interfacing surface, such as the sleeping surface of an air mattress, which includes a breathable multilayer mesh which separates the user from the underlying air-impermeable sheet. The breathable mesh is made from a material such as 3D fabric, which is resiliently deformable while also allowing for airflow through and around the volume of the mesh material of the breathable interface material. When a person contacts the inflatable furniture, her or his body comes into direct contacts with the breathable mesh. The mesh then resiliently deforms such that airflow through and around the mesh is still permitted. This airflow allows heat and moisture from the user to dissipate through mesh of the breathable interface material. This, in turn, enhances the comfort of the breathable mesh, while also reducing the potential for the proliferation of bacteria and mites on the user-contacting surface.

35 Claims, 6 Drawing Sheets

(56) References Cited

U.S. PATENT DOCUMENTS

| | | | | |
|---|---|---|---|---|
| 2004/0237203 | A1 | 12/2004 | Romano et al. | |
| 2006/0080778 | A1* | 4/2006 | Chambers | A47C 27/082 5/652.2 |
| 2006/0168736 | A1 | 8/2006 | Meyer et al. | |
| 2013/0025053 | A1 | 1/2013 | Vrzalik | |
| 2013/0230671 | A1* | 9/2013 | Lin | A47C 27/081 428/12 |

FOREIGN PATENT DOCUMENTS

| | | |
|---|---|---|
| CN | 202005494 | 10/2011 |
| EP | 2739255 | 6/2014 |

* cited by examiner

INFLATABLE PRODUCT WITH BREATHABLE USER INTERFACE

CROSS REFERENCE TO RELATED APPLICATION

This application is a U.S. National Stage Application of International Application No. PCT/M2018/054638, filed Jun. 22, 2018 and entitled INFLATABLE PRODUCT WITH BREATHABLE USER INTERFACE, which claims priority to Chinese Application No. CN 201720732602.5, filed Jun. 22, 2017 and entitled AN AIRBED STRUCTURE, the entire disclosures of which are hereby incorporated by reference herein.

BACKGROUND

1. Field of the Disclosure

The present disclosure relates to an inflatable product, and more particularly, a inflatable furniture item having a breathable user interface.

2. Description of the Related Art

Inflatable furniture items, such as inflatable air mattresses, are commonly used. For example, air mattresses can be inflated when needed, then deflated and folded or rolled up for compact storage and transport when not in use. Such air mattresses provide flexible sleeping solutions with adjustable firmness and comfort for, e.g., guest accommodation or camping. In some applications, air mattresses are used as a mattress for an extended period.

Existing air mattresses may have a flocked and/or grooved upper sheet to attempt to provide enhanced comfort and ventilation for the user in contact with the upper surface. However, because an air mattress is soft and pliable, the grooves may become enclosed when a person lays on the air mattress, limiting or eliminating airflow through the sleeping surface. Moreover, flocked sheets used with air mattresses may enhance the softness of the sleeping surface but are not breathable. This lack of breathability prevents the evaporation of moisture from people sleeping on the air mattress, producing less than optimal comfort. In extended use, the cleanliness of flocked surfaces may also prove difficult to maintain.

What is needed is an improvement over the foregoing.

SUMMARY

The present disclosure provides an inflatable furniture design in which the user-interfacing surface, such as the sleeping surface of an air mattress, includes a breathable multilayer mesh which separates the user from the underlying air-impermeable sheet. The breathable mesh is made from a material such as 3D fabric, which is resiliently deformable while also allowing for airflow through and around the volume of the mesh material of the breathable interface material. When a person contacts the inflatable furniture, her or his body comes into direct contacts with the breathable mesh. The mesh then resiliently deforms such that airflow through and around the mesh is still permitted. This airflow allows heat and moisture from the user to dissipate through mesh of the breathable interface material. This, in turn, enhances the comfort of the breathable mesh, while also reducing the potential for the proliferation of bacteria and mites on the user-contacting surface.

In one form thereof, the present disclosure provides an air mattress including: a first sheet defining a first exterior surface of the air mattress; a second sheet defining a second exterior surface of the air mattress; a sidewall having a first portion sealingly connected to a periphery of the first sheet and a second portion sealingly connected to a periphery of the second sheet, the first sheet, the second sheet and the sidewall all being substantially air impermeable and cooperating to define a substantially sealed inflatable chamber; and a breathable interface material connected to at least one of the first exterior surface and the second exterior surface of the air mattress. The breathable interface material includes: an upper sheet having an upper plurality of apertures formed therethrough; a lower sheet spaced from the upper sheet; and a resiliently deformable intermediate layer disposed between the upper sheet and the lower sheet and cooperating with the upper and lower sheets to define a volume of the breathable interface material, whereby the breathable interface material is operable to facilitate air flow from the upper sheet through and around the volume.

In another form thereof, the present disclosure provides an air mattress including: an upper sheet defining an upper exterior surface of the air mattress; a lower sheet defining a lower exterior surface of the air mattress; a sidewall having an upper portion sealingly connected to a periphery of the upper sheet and a lower portion sealingly connected to a periphery of the lower sheet, the upper sheet, the lower sheet and the sidewall all being substantially air impermeable and cooperating to define a substantially sealed inflatable chamber; an upper breathable interface material that is resiliently deformable and allows a flow of air and/or moisture through its volume; and an upper frame having an outer periphery which attaches to a periphery of the upper sheet and an internal aperture with an internal periphery attached to the upper breathable interface material, such that the upper breathable interface material is connected to the upper sheet via the frame.

BRIEF DESCRIPTION OF THE DRAWINGS

The above mentioned and other features and advantages of this disclosure, and the manner of attaining them, will become more apparent and the invention itself will be better understood by reference to the following description of embodiments of the invention taken in conjunction with the accompanying drawings, wherein.

DETAILED DESCRIPTION

Figure 1:
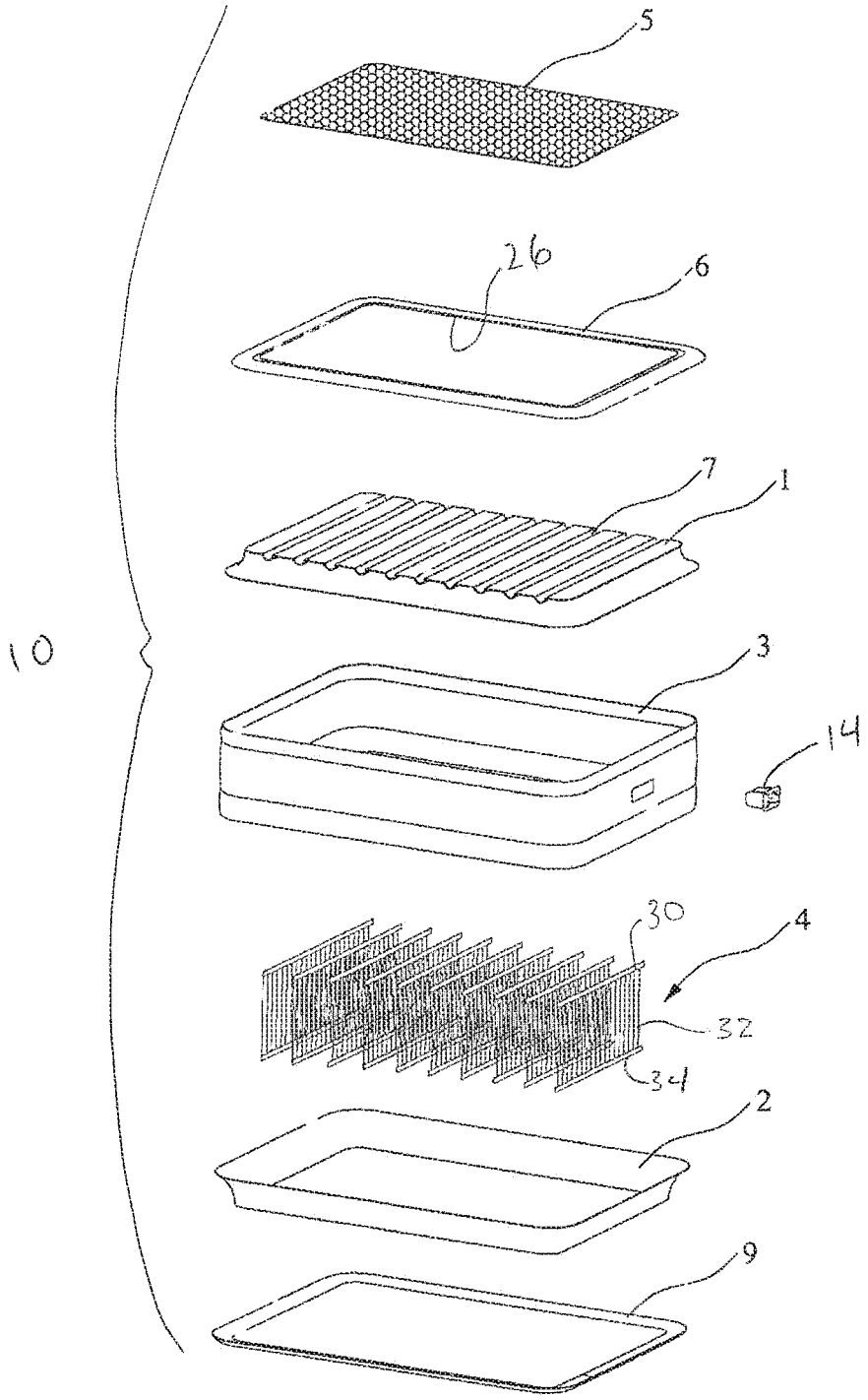
FIG. 1 is a perspective, exploded view of an air mattress made in accordance with the present disclosure.
Figure 2:
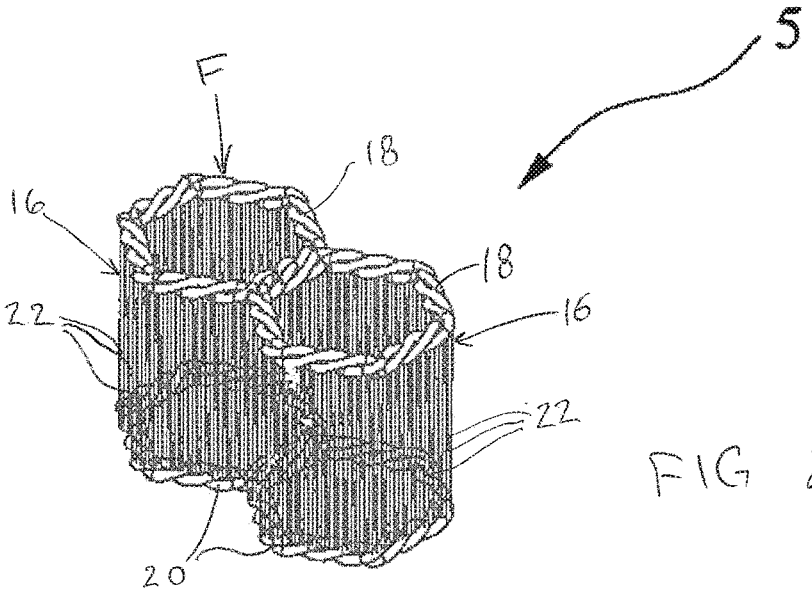
FIG. 2 is an enlarged perspective view of a portion of a the breathable mesh used in the air mattress of FIG. 1.
Figure 3:
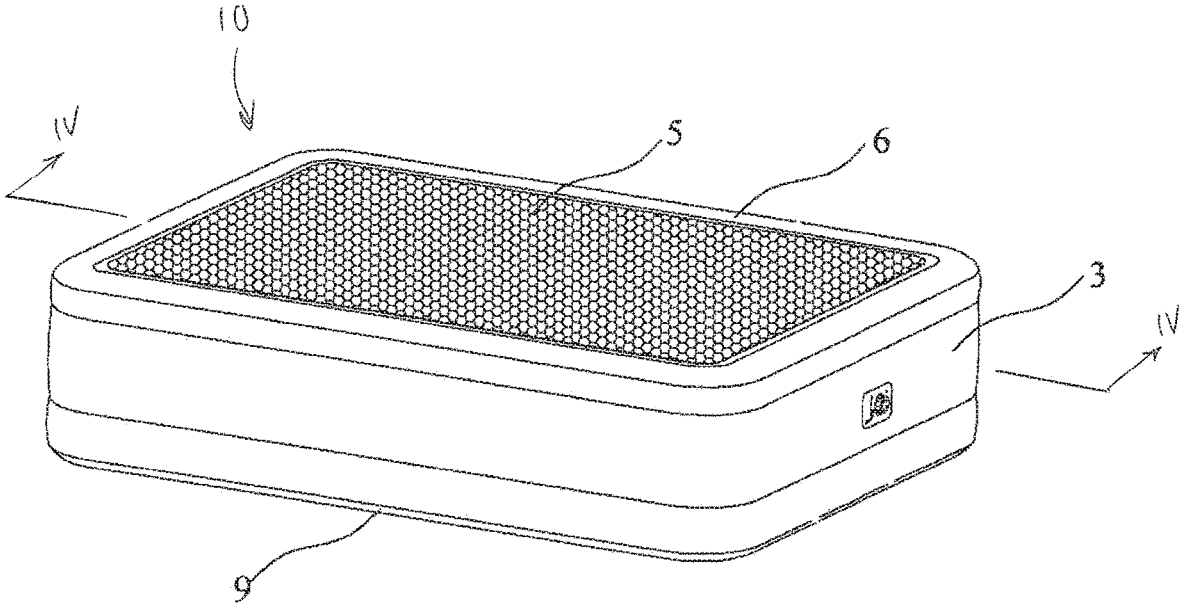
FIG. 3 a perspective view of the air mattress of FIG. 1, shown fully assembled.
Figure 4:
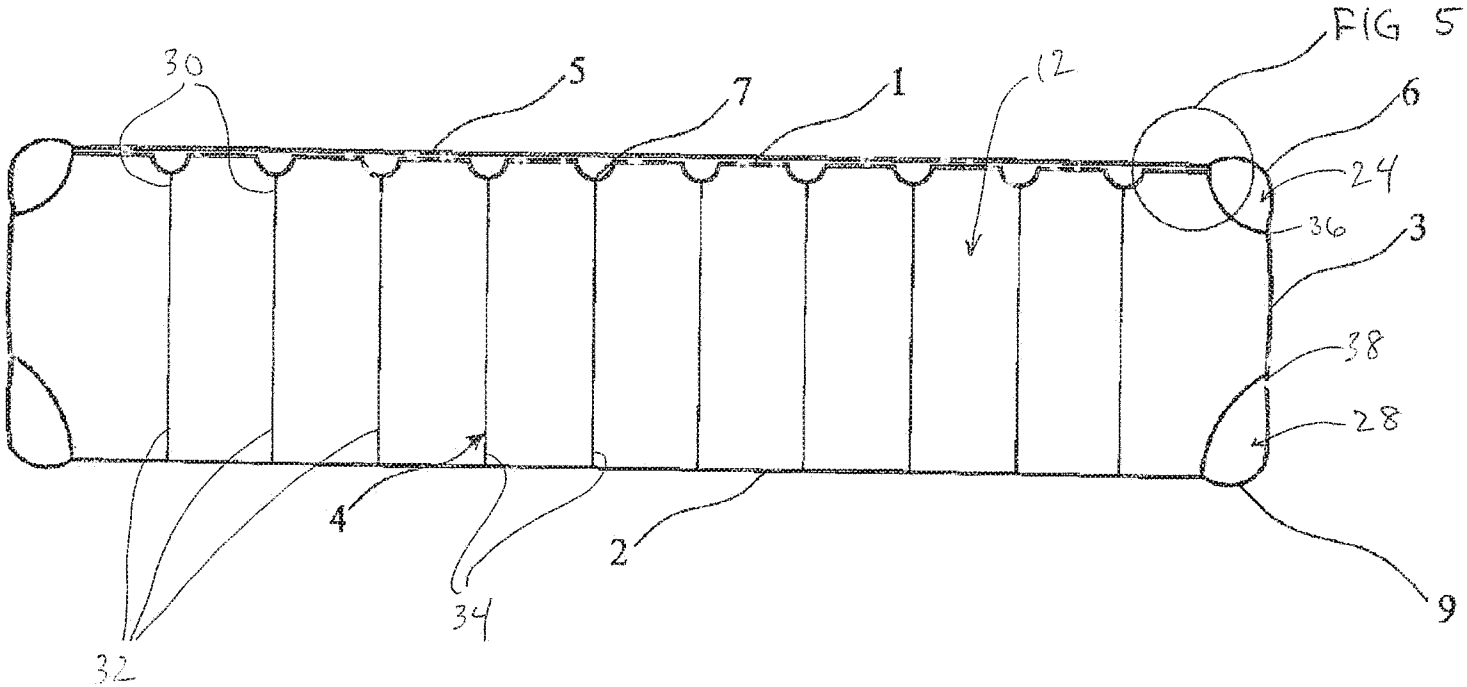
FIG. 4 is an elevation, section view of the air mattress shown in FIG. 3, taken along the line IV-IV of FIG. 3.

The present disclosure provides an inflatable furniture item, such as air mattress 10 illustrated in FIGS. 1, 2 and 4, which includes at least one breathable mesh material 5 designed to facilitate airflow between the body of a person using the inflatable furniture and the adjacent air-impermeable surface of the furniture, illustratively the upper sheet 1 of air mattress 10.

For purposes of the present disclosure, the use of breathable mesh material 5 is described in the context of air mattress 10, which may be deployed as an inflatable mattress of the type used for guest rooms, camping and the like. However, it is contemplated that other inflatable furniture items may include similar mesh material at the user interface. For example, an inflatable chair may include a mesh material similar to mesh material 5 on the seat surface, or inflatable spas or pools may include such a mesh material on any of the various sitting or standing surfaces thereof, or an inflatable float may include such a mesh material on at along the surfaces designed to support the user. Moreover, any inflatable item designed to bear the weight of user on one or more of its air-impermeable surfaces may benefit from the use of mesh material similar to mesh material 5 as described herein in the context of inflatable air mattress 10.

Turning now to FIG. 1, an exploded view of air mattress 10 illustrates its constituent components. Air mattress 10 includes upper sheet 1, lower sheet 2 spaced from upper sheet 1 to form a gap therebetween, and sidewall 3 interconnecting the upper and lower sheets 1, 2 and enclose an inflatable chamber 12 (FIG. 4). Upper sheet 1, lower sheet 2, and sidewall 3 are all substantially air-impermeable, and the peripheries of the upper sheet 1 and the lower sheet 2 are sealingly connected (e.g., by welding) to upper and lower portions of the sidewall 3 respectively. Air mattress 10 can be inflated and deflated via a pump 14 (FIG. 1) or another pump and/or valve arrangement, which in the illustrated embodiment is integrated into sidewall 3 of air mattress 10. The sealed connections and impermeable materials of upper sheet 1, lower sheet 2, and sidewall 3 ensure that after inflation, air mattress 10 will retain the pressurized air over an extended period. In an exemplary embodiment, sheets 1 and 2 and sidewall 3 are all made from a common material amenable to joinder by sonic or thermal welding, such as polyvinyl chloride (PVC).

For purposes of the present disclosure, sheets 1, 2 and sidewall 3 can be considered "substantially air impermeable" where air mattress 10 can retain pressurized air at 80% of its initial pressurization for a period of at least 8 hours. Thus, where air mattress 10 is pressurized at 0.5 pounds per square inch (psi), air mattress 10 can be considered substantially air impermeable if retained pressure after 8 hours is at least 0.4 psi.

The overall cuboid, mattress-like shape of air mattress 10 is maintained by an arrangement of tensioning structures 4 contained within inflatable chamber 12, which in the illustrated embodiment extend across the width of air mattress 10 and are spaced apart along its length. The upper and lower ends of each tensioning structure 4 are welded to the internal surfaces of the upper sheet 1 and the lower sheet 2 respectively. In the embodiment of FIG. 1, each tensioning structure 4 includes a first pair of weld strips 30 at the upper end which captures the upper ends of a fabric or other arrangement of threads 32. Similarly, a second pair of weld strips 34 at the lower end of each tensioning structure 4 captures the lower ends of the fabric or arrangement of threads 32. The pairs of weld strips 30, 34 are then welded to the upper and lower sheets 1, 2 respectively. Additional details of exemplary tensioning structures useable in air mattress 10 can be found in U.S. Pat. No. 9,802,359, filed Jul. 28, 2014 and entitled METHOD FOR PRODUCING AN INFLATABLE PRODUCT, the entire disclosure of which is hereby expressly incorporated herein by reference.

Referring still to FIG. 1, upper sheet 1 has an upper surface (i.e., the outer surface opposite inflatable chamber 12) includes breathable interface material 5, which is a multilayer mesh structure which can be resiliently deformed by a user laying on air mattress 10 without being fully compressed. For example, FIG. 2 shows a small portion of breathable interface material 5 in which a pair of interconnected columns 16 are woven together to form a 3D mesh material. In this arrangement, each column 16 has an upper yarn 18 and a lower yarn 20 interconnected to one another via a resilient intermediate layer, illustrated as a plurality of filaments 22. Filaments 22 are made from a semi-rigid material, such as a polymer of sufficient thickness to allow filaments 22 to remain straight and unbuckled under its own weight, the weight of upper yarn 18, and in some cases, an additional external force F. In an exemplary embodiment, filaments 22 are made from polyester. Collectively, filaments 22 impart a compressive strength to each column 16 capable of withstanding a given force F before resiliently buckling or otherwise allowing upper yarn 18 to move resiliently downwardly toward lower yarn 20. Application of a larger force F will cause additional resilient deformation of filaments 22, in the manner of a spring. In other embodiments, the resilient intermediate layer may be any other resiliently deformable, air-permeable and preferably foldable material, such as open cell foam.

FIG. 2 also illustrates the interconnection of upper and lower yarns 18, 20. In the illustrated embodiment, each yarn 18, 20 is formed from a plurality of twisted fibers, and which are in turn twisted in connection with one another at the junction between two columns. In an exemplary embodiment, yarns 18 and 20 are made from polymer fibers, such as polyester. To form breathable interface material 5, columns 16 are interwoven into an interconnected matrix of columns 16, which each interior column 16 connected to a plurality (e.g., six) of other columns 16 around its periphery. In this way, interface 5 is formed as an upper woven sheet made from a matrix of interconnected upper yarns 18, a lower woven sheet made from a matrix of interconnected lower yarns 20, and a mesh of generally parallel filaments 22 disposed therebetween. In the illustrated embodiment, each of the upper and lower sheets of interface 5 has a plurality of apertures (i.e., one circular aperture per column 16 and a three-point, star-shaped aperture between adjacent sets of three columns 16), such that air can flow freely through and among the various columns 16 which define the volume of interface 5. In other exemplary embodiments, the upper and lower woven sheets of interface 5 may be formed from any suitable weave or other breathable fabric material, with at least the upper sheet having a plurality of apertures operable to facilitate a flow of air and moisture therethrough. In one particular exemplary embodiment, for example, the lower sheet of interface 5 may be a relatively loose "standard" weave such as a warp knit, while the top sheet of interface 5 may be a knit forming large apertures, such as a Raschel knit. In this embodiment, the relatively dense warp knit provides a high-strength attachment area along the bottom surface of interface 5 (as described further below with regard to attachment frame 6), while the relatively open Raschel knit provides a highly breathable top surface along the user interface with air mattress 10.

The plurality of filaments 22 also provides for the resilient compressibility of breathable interface material 5. As noted above, each filament has a compressive strength which can be overcome by a compressive force F of sufficient magnitude. In interface 5, filaments 22 are distributed substantially evenly throughout the area of the upper yarns 18 and lower yarns 20, such that filaments 22 collectively provide a resilience per unit area which allows breathable interface material 5 to remain at least partially expanded under typical compressive forces arising from a supine body laying on air mattress 10. In particular, a human body typically exerts pressures between about 1.5 psi and about 8 psi, depending on the size, weight and orientation of the body upon the sleeping surface of air mattress 10 (e.g., resting on one's back or side). Within this pressure range, the thickness and density of filaments 22 across the surface area of breathable interface material 5 is calculated to avoid full compression. For purposes of the present discussion, "full" or "complete" compression is a compression of filaments 22 which allows upper yarns 18 to come into contact with lower yarns 20, such that airflow between columns 16 is prevented or severely curtailed. Conversely, a lack of full compression retains air spaces and air channels between and among columns 16, such that air can flow through and between columns 16. This airflow includes lateral air movement through filaments 22, such that air is allowed to flow "sideways" through the thickness dimension of interface 5 as well as vertically through the apertures through and between columns 16.

In an exemplary embodiment, some resilient deformation of filaments 22 is permitted in the above-described pressure range, even as full compression is avoided. This allows breathable interface material 5 to have a feeling of softness and "give" as the user lays upon interface 5 while retaining the ability for airflow. In one embodiment, breathable interface material 5 may have a thickness between ⅛ inch and 0.5 inches, such as about 0.25 inches, in order to allow for some deformation and compression without allowing full compression. Moreover, to the extent that compression of filaments 22 is allowed and facilitated by the thickness and density of filaments 22, such compression results only from elastic, rather than plastic, deformation of filaments 22. This elastic-only deformation ensures that breathable interface material 5 can resiliently regain its original shape after force F (FIG. 2) is removed. In the context of pressures applied to an air mattress, such as air mattress 10 as described above, filaments 22 may have a diameter between 0.0014 inches and 0.0031 inches, such as about 0.002 inches and a density between 1600 filaments and 2500 filaments per square inch, such as about 2000 filaments per square inch.

The application of the multilayer mesh structure of breathable interface material 5 to air mattress 10 promotes breathability and moisture-penetrability at the sleeping surface. When a user of air mattress 10 lies on the sleeping surface thereof, his or her body may contact the breathable interface material 5 rather than the air-impermeable surface of upper sheet 1. Because air flow is maintained through interface 5, the heat and moisture of the user's body is allowed to dissipates into breathable interface material 5, where it can be "swept away" by convective air currents or any other ambient air flow in the vicinity of air mattress 10.

To further enhance this airflow, upper sheet 1 may include a plurality of grooves or channels 7 as shown in FIGS. 1 and 4. As best seen in FIG. 4, channels 7 are longitudinal voids built into the shape of upper sheet 1 which act to allow air currents to flow underneath breathable interface material 5. In an exemplary embodiment, the interior surface of upper sheet 1 may be connected (e.g., by welding) to tensioning structures 4 at the nadir of respective channels 7, such that tension borne by tensioning structures 4 also pulls downwardly on channels 7 and thereby urges channels 7 to remain continuously open across the entire width of air mattress 10. In an exemplary embodiment, channels 7 may be nominally between 0.1 inches and 1.5 inches deep, such as 1.0 inch deep, in order to ensure that the entire longitudinal extent of channels 7 remain open to air flow during normal use of air mattress 10 as a sleeping surface. For purposes of the present disclosure, "nominal" depth of channels 7 refers to the depth from the nadir of each channel 7 to the exterior surface of upper sheet 1, when air mattress 10 is inflated to a typical pressure for use as a sleeping surface. In the illustrative embodiment of FIG. 1, channels 7 run the entire lateral extent of the upper sleeping surface defined by upper sheet 1, such that channels 7 are open at the periphery of sheet 1.

In this way, breathable interface material 5 enhances comfort by keeping the user dry and avoiding direct contact with a warm or cold upper sheet 1. The air flow afforded by breathable interface material 5 also reduces the potential for bacteria and mites to live and/or proliferate, thereby promoting a sanitary sleeping surface. In some embodiments, an antibacterial and/or insecticide coating may be applied to the fibers or within the interstices of material 5 for further protection against bacteria, mites and the like.

As noted above, breathable interface material 5 may attach to upper sheet 1 such that breathable interface material 5 is an integral part of air mattress 10. In the illustrative embodiment of FIG. 1, air mattress 10 includes frame 6, which is a generally rectangular sheet having an outer periphery which attaches to the periphery of upper sheet 1 (e.g., by welding), and a large internal aperture with an internal periphery which attaches to breathable interface material 5 (e.g., by sewing or a zipper attachment, as described below). In an exemplary embodiment, frame 6 is made from the same material as sheets 1, 2 and sidewall 3, e.g., PVC.

Figure 5:
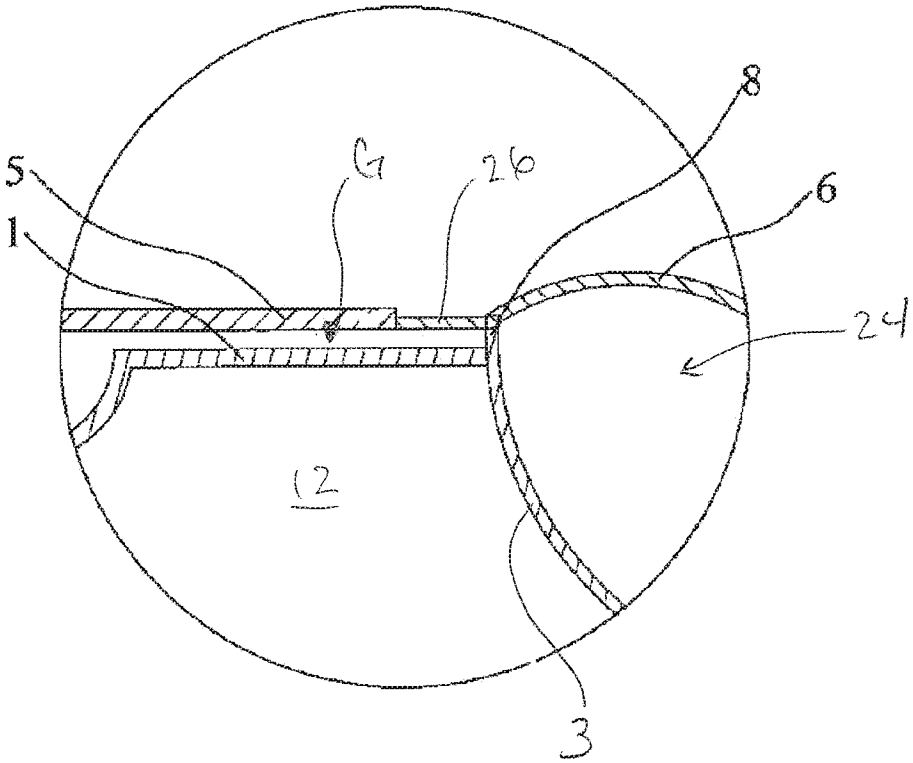
FIG. 5 is an enlarged view of a portion of the air mattress shown in FIG. 4.

Referring to FIGS. 4 and 5, a portion of sidewall 3 may protrude upwardly from the attachment seam with frame 6, such that a retainer portion 8 of sidewall 3 sits proud of the upper (i.e., exterior) surface of upper sheet 1. As best seen in FIG. 5, the inner peripheral portion of frame 6 is welded to a retainer portion 8 of sidewall 3, above the point of (welded) attachment between upper sheet 1 and sidewall 3. The opposing outer peripheral portion of frame 6 is welded to an interior surface of sidewall 3 at a lower junction 36 (FIG. 1), well below the point of attachment between upper sheet 1 and sidewall 3. This arrangement leads to sidewall 3 and frame 6 cooperating to form corner pocket 24 which extends around the periphery of air mattress 10. Corner pocket 24 may serve as a "bumper" or barrier to help users of air mattress 10 avoid rolling off the sleeping surface unintentionally.

Referring to FIG. 5, the welded attachment between upper sheet 1 and sidewall 3 is vertically separated from the welded attachment between frame 6 and sidewall 3, such that a gap G is formed between the lower surface of breathable interface material 5 and the adjacent upper surface of upper sheet 1. When breathable interface material 5 is pulled taut upon inflation of air mattress 10, this gap G allows breathable interface material 5 to absorb and disperse some of the force F placed upon it by a user, creating a soft and comfortable feel to the sleeping surface. In addition, gap G further ensures that no moisture will be retained between upper sheet 1 and breathable interface material 5, further promoting the comfort and hygiene benefits of interface 5 as discussed above.

In one exemplary embodiment best shown in FIGS. 1 and 5, the outer periphery of breathable interface material 5 connects to the inner periphery of frame 6 via zipper 26. Zipper 26 allows breathable interface material 5 to be easily attached and detached from frame 6 and air mattress 10, such that breathable interface material 5 may be periodically cleaned without the necessity of cleaning the entire air mattress 10. Alternatively, breathable interface material 5 may be permanently attached to frame by, e.g., sewing.

Air mattress 10 may also include lower frame 9 shown in FIGS. 1 and 4, which is similar in structure and function to the upper frame 6 but is attached to the lower portion of sidewall 3 adjacent to lower sheet 2. In particular, lower frame 9 has an inner peripheral portion which is welded to sidewall 3 at or near the connection between second sheet 2 and sidewall 3, and an outer peripheral portion welded to an interior surface of sidewall 3 at an upper junction 38. Lower frame 9 creates a lower corner pocket 28 extending around the periphery of air mattress (10) which promotes stability by counteracting any tendency for the lower corners of air mattress 10 to "roll" when a user is placing pressure on one side or the other, e.g., sitting or laying near the edge of the sleeping surface.

Figure 6:
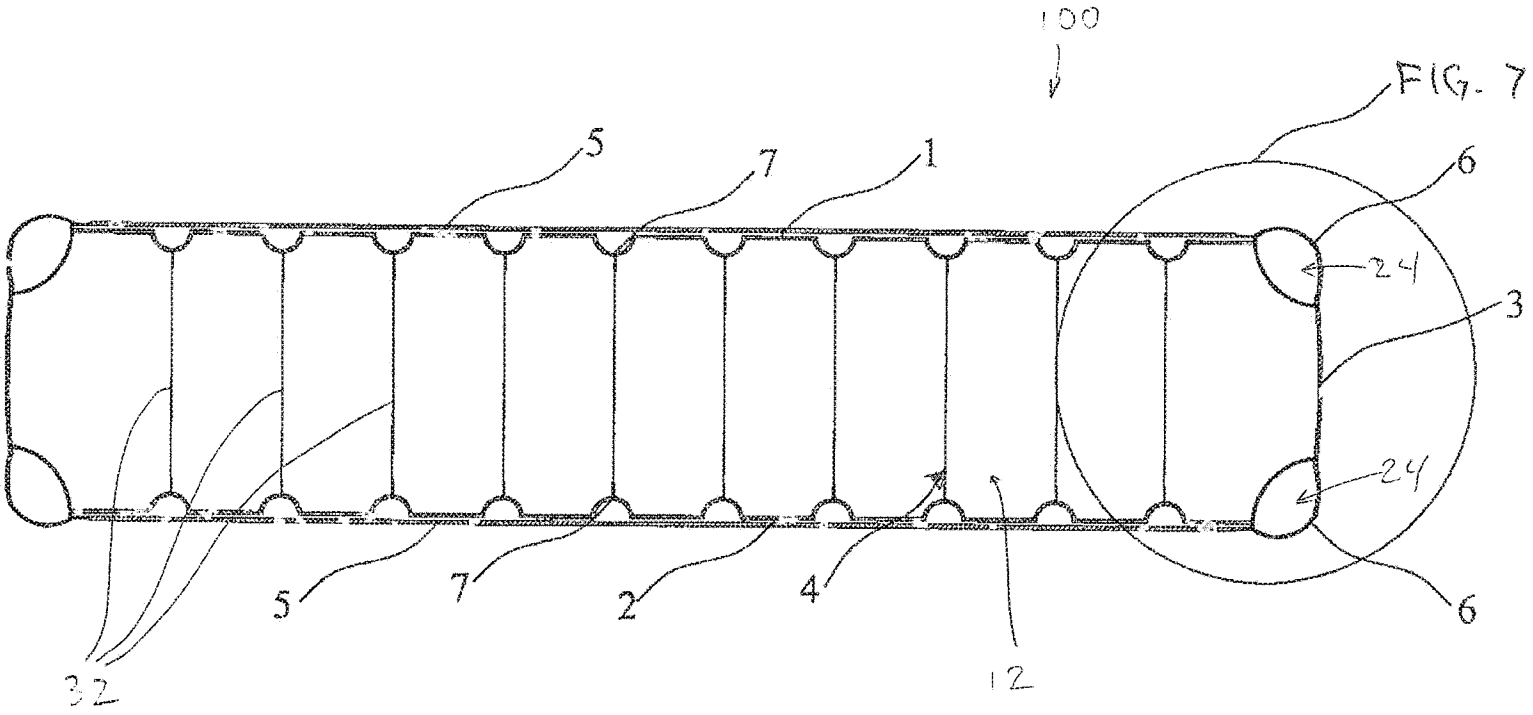
FIG. 6 is an elevation, section view of another air mattress made in accordance with the present disclosure.
Figure 7:
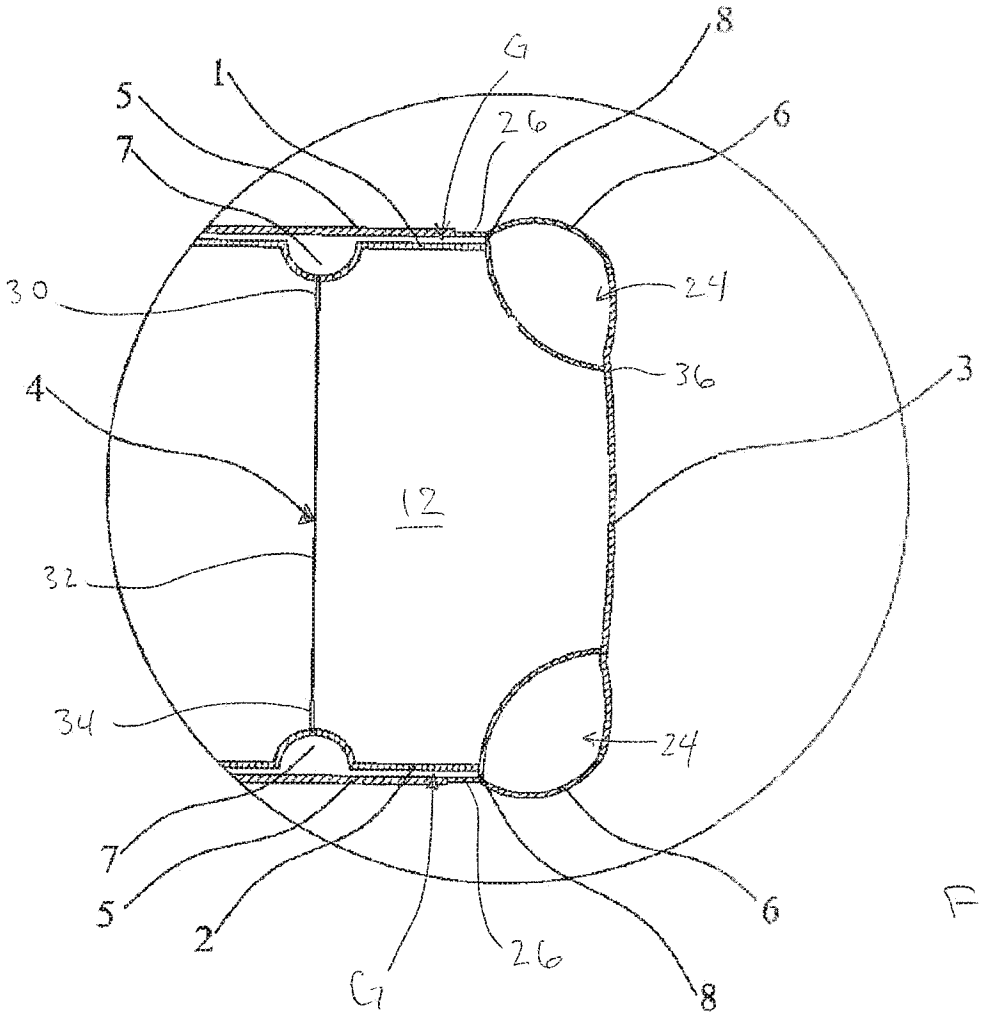
FIG. 7 is the enlarged view of a portion of the air mattress shown in FIG. 5.

Turning now to FIGS. 6-7, air mattress 110 is shown. Air mattress 110 is similar to air mattress 10 described in detail above, and similar features of air mattresses 110 have similar reference numbers, except with 100 added thereto. Where features or structures of air mattress 110 are the same as air mattress 10, the same reference number is used. However, air mattress 110 includes two breathable interface materials 5, with one interface 5 being adjacent upper sheet 1 and the other interface 5 adjacent lower sheet 2.

For purposes of the present discussion, sheet 1 is referred to as an "upper" sheet insofar as it is shown in an upper position in FIGS. 1 and 4-7, it being understood that air mattresses 10, 110 can of course be oriented in various ways as required or desired by the user, and that the notion of "upper" and "lower" structures pertains to air mattress 10 when inflated, even though sheets 1 and 2 (and other structures) retain their structural integration into air mattress 10 even in a folded and collapsed configuration. Similarly, "lower" sheet 2 is referred to as such because it is the shown on the bottom of air mattresses 10, 110 in the figures. In the configuration of FIG. 1, upper sheet 1 is designated specifically as a sleeping surface because it includes breathable interface material 5 designed as the user interface, while the lower sheet 2 is designated as a ground-contacting surface because it lacks interface material 5.

However, because air mattress 110 includes breathable interface materials 5 at both the upper and lower sheet 1 and 2, air mattress 110 provides two sleeping surfaces which benefit from the enhanced comfort and hygiene provided by breathable interface material 5 as described in detail above with respect to air mattress 10. Air mattress 110 can be used either "right-side up" with upper sheet 1 in the upper position to be used as a sleeping surface in conjunction in the upper breathable interface material 5 or "upside-down" with lower sheet 2 used as the sleeping surface in conjunction with breathable interface material 5. Moreover, a user may alternate which sleeping surface of air mattress 110 is used.

In the illustrative embodiment of FIGS. 6 and 7, both the upper and lower breathable interface materials 5 are connected to sidewall 3 via frame 6, in the same manner as described in detail above with respect to air mattress 10. As best seen in FIG. 7, breathable interface materials 5 are connected to frames 6 by respective zippers 26, though sewing may also be used as described above. Both interface materials 5 may define gap G with respect to upper and lower sheets 1, 2 respectively. Longitudinal channels 7 may be provided in both the upper sheet 1 and the lower sheet 2 to aid in air and moisture flows across breathable interface materials 5. Moreover, either or both of breathable interface materials 5 may include any feature or set of features described above with respect to air mattress 10 having a single breathable interface material 5.

While this invention has been described as having an exemplary design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An air mattress comprising:

a first sheet defining a first exterior surface of the air mattress;

a second sheet defining a second exterior surface of the air mattress;

a sidewall having a first portion sealingly connected to a periphery of the first sheet and a second portion sealingly connected to a periphery of the second sheet, the first sheet, the second sheet and the sidewall all being substantially air impermeable and cooperating to define a substantially sealed inflatable chamber;

a frame having an outer periphery which attaches to the periphery of the first sheet and an internal aperture with an internal periphery; and a breathable interface material occupying the internal aperture and attached to the internal periphery of the frame, the breathable interface material comprising:

an upper sheet having an upper plurality of apertures formed therethrough;

a lower sheet spaced from the upper sheet; and a resiliently deformable intermediate layer disposed between the upper sheet and the lower sheet and cooperating with the upper and lower sheets to define a volume of the breathable interface material, whereby the breathable interface material is operable to facilitate air flow from the upper sheet through and around the volume, wherein:

an inner peripheral portion of the frame is welded to a retainer portion of sidewall which sits proud of a welded connection between the sidewall and the first sheet, and an outer peripheral portion of the frame is welded to an interior surface of the sidewall at a lower junction, such that the frame and the sidewall cooperate to form a corner pocket extending around the periphery of the air mattress.

2. The air mattress of claim 1, wherein:

the upper sheet of the breathable interface material comprises an interconnected matrix of upper yarns, and the lower sheet of the breathable interface material comprises an interconnected matrix of lower yarns.

3. The air mattress of claim 1, wherein the breathable interface material comprises a 3D mesh material in which the resiliently deformable intermediate layer comprises a mesh of generally parallel filaments disposed between and respectively connected to the upper and lower sheets of the breathable interface material.

4. The air mattress of claim 3, wherein the filaments are made from a semi-rigid material of sufficient thickness to allow the filaments to remain straight and unbuckled under its own weight and under the weight of the upper sheet of the breathable interface material, and to resiliently deform under a force applied to the upper sheet of the breathable interface material.

5. The air mattress of claim 3, wherein the filaments are distributed substantially evenly throughout the area of the upper and lower sheets of the breathable interface material, such that the filaments collectively provide a resilience per unit area which allows the breathable interface material to remain at least partially expanded under pressures between about 1.5 psi and about 8 psi, whereby the breathable interface material is resiliently deformable under the weight a supine human user of the air mattress.

6. The air mattress of claim 5, wherein the filaments each have a diameter between 0.0014 inches and 0.0031 inches and a density between 1600 filaments and 2500 filaments per square inch.

7. The air mattress of claim 3, wherein the breathable interface material defines a thickness between its upper sheet and its lower sheet, the thickness between ⅛ inch and ½ inch.

8. The air mattress of claim 1, further comprising a plurality of tensioning structures, the upper and lower ends of each tensioning structure welded to the internal surfaces of the upper and lower sheets respectively.

9. The air mattress of claim 8, wherein each tensioning structure comprises:

an arrangement of threads;

a first pair of weld strips which captures upper ends of the arrangement of threads, at least one of the first pair of weld strips welded to the first sheet of the air mattress; and a second pair of weld strips which captures lower ends of the arrangement of threads, at least one of the second pair of weld strips welded to the second sheet of the air mattress.

10. The air mattress of claim 1, further comprising at least one of a valve and a pump integrated into the sidewall and operable to inflate and pressurize the substantially sealed inflatable chamber.

11. The air mattress of claim 1, wherein the first sheet, the second sheet and the sidewall are all made from a common material amenable to joinder by sonic or thermal welding.

12. The air mattress of claim 11, wherein the common material is polyvinyl chloride (PVC).

13. The air mattress of claim 1, wherein the substantially sealed inflatable chamber can retain pressurized air at 80% of an initial pressurization for a period of 8 hours.

14. The air mattress of claim 1, wherein the breathable interface material is not in fluid communication with the substantially sealed inflatable chamber.

15. The air mattress of claim 14, wherein the breathable interface material is configured to sweep away heat and moisture by convective air currents or ambient air flow.

16. The air mattress of claim 1, further comprising a zipper connecting a periphery of the breathable interface material to the frame.

17. The air mattress of claim 1, wherein a periphery of the breathable interface material is sewn to the frame.

18. The air mattress of claim 1, wherein the first sheet of the air mattress is an upper sheet and the second sheet is a lower sheet, the breathable interface material disposed on the upper sheet to form a sleeping surface of the air mattress, the lower sheet forming a ground-contacting surface.

19. The air mattress of claim 18, wherein the first exterior surface of the first sheet includes a plurality of channels formed as longitudinal voids built into the shape of the first sheet, the longitudinal voids sized and configured to allow air currents to flow underneath the breathable interface material.

20. The air mattress of claim 19, further comprising a plurality of tensioning structures, the upper and lower ends of each tensioning structure welded to the internal surfaces of the upper and lower sheets, wherein:

the tensioning structures are connected to the interior of the first sheet at respective nadirs of the channels, such that tension borne by the tensioning structures when the air mattress is inflated also pulls downwardly on the channels.

21. The air mattress of claim 19, wherein the channels are nominally between 0.1 inches and 1.5 inches deep.

22. The air mattress of claim 19, wherein the channels run the entire lateral extent of the first exterior surface of the first sheet, such that the channels are open at the periphery of the first sheet.

23. The air mattress of claim 1, wherein a connection between the first sheet and the sidewall is vertically separated from the attachment between the frame and the sidewall, such that a gap is formed between a lower surface of the breathable interface material and the adjacent first exterior surface of the first sheet.

24. The air mattress of claim 1, further comprising a lower frame having an inner peripheral portion which is welded to the sidewall at or near a connection between the second sheet and the sidewall, and an outer peripheral portion welded to an interior surface of the sidewall at an upper junction such that the lower frame and the sidewall cooperate to form a lower corner pocket extending around the periphery of the air mattress.

25. The air mattress of claim 1, wherein the outer periphery of the frame is fixed to the periphery of the first sheet, and the internal periphery of the frame is fixed to the breathable interface material, such that the breathable interface material is an integral part of the air mattress.

26. An air mattress comprising:

an upper sheet defining an upper exterior surface of the air mattress;

a lower sheet defining a lower exterior surface of the air mattress;

a sidewall having an upper portion sealingly connected to a periphery of the upper sheet and a lower portion sealingly connected to a periphery of the lower sheet, the upper sheet, the lower sheet and the sidewall all being substantially air impermeable and cooperating to define a substantially sealed inflatable chamber;

an upper breathable interface material that is resiliently deformable and allows a flow of air and/or moisture through its volume;

an upper frame having an outer periphery which attaches to a periphery of the upper sheet and an internal aperture with an internal periphery attached to the upper breathable interface material, such that the upper breathable interface material is connected to the upper sheet via the frame;

a lower breathable interface material that is resiliently deformable and allows a flow of air and/or moisture through its volume; and a lower frame having an outer periphery which attaches to a periphery of the lower sheet and an internal aperture with an internal periphery attached to the lower breathable interface material, such that the lower breathable interface material is connected to the lower sheet via the frame.

27. The air mattress of claim 26, wherein:

the upper exterior surface of the upper sheet includes a plurality of upper channels formed as upper longitudinal voids built into the shape of the upper sheet, the upper longitudinal voids sized and configured to allow air currents to flow between the upper breathable interface material and the upper exterior surface; and the lower exterior surface of the lower sheet includes a plurality of lower channels formed as lower longitudinal voids built into the shape of the lower sheet, the lower longitudinal voids sized and configured to allow air currents to flow between the lower breathable interface material and the lower exterior surface.

28. The air mattress of claim 27, further comprising a plurality of tensioning structures, the upper and lower ends of each tensioning structure welded to the internal surfaces of the upper and lower sheets, wherein:

the tensioning structures are connected to the interior of the upper sheet at respective nadirs of the upper channels, such that tension borne by the tensioning structures when the air mattress is inflated also pulls downwardly on the upper channels, and the tensioning structures are connected to the interior of the lower sheet at respective nadirs of the lower channels, such that tension borne by the tensioning structures when the air mattress is inflated also pulls upwardly on the lower channels.

29. The air mattress of claim 27, wherein the upper and lower channels are all nominally between 0.1 inches and 1.5 inches deep.

30. The air mattress of claim 27, wherein:

the upper channels run the entire lateral extent of the upper exterior surface of the upper sheet, such that the upper channels are open at the periphery of the upper sheet, and the lower channels run the entire lateral extent of the lower exterior surface of the lower sheet, such that the lower channels are open at the periphery of the lower sheet.

31. The air mattress of claim 26, wherein:

the connection between the upper sheet and the sidewall is vertically separated from the attachment between the upper frame and the sidewall, such that an upper gap is formed between a lower surface of the upper breathable interface material and the adjacent upper exterior surface of the first sheet, and the connection between the lower sheet and the sidewall is vertically separated from the attachment between the lower frame and the sidewall, such that a lower gap is formed between an upper surface of the lower breathable interface material and the adjacent lower exterior surface of the lower sheet.

32. The air mattress of claim 26, wherein the outer periphery of the upper frame is fixed to the periphery of the upper sheet, and the internal periphery of the upper frame is fixed to the upper breathable interface material, such that the upper breathable interface material is fixed to the upper sheet via the frame.

33. The air mattress of claim 26, wherein the breathable interface material is not in fluid communication with the substantially sealed inflatable chamber.

34. The air mattress of claim 33, wherein the breathable interface material is configured to sweep away heat and moisture by convective air currents or ambient air flow.

35. An air mattress comprising:

a first sheet defining a first exterior surface of the air mattress;

a second sheet defining a second exterior surface of the air mattress;

a sidewall having a first portion sealingly connected to a periphery of the first sheet and a second portion sealingly connected to a periphery of the second sheet, the first sheet, the second sheet and the sidewall all being substantially air impermeable and cooperating to define a substantially sealed inflatable chamber;

a frame having an outer periphery which attaches to the periphery of the first sheet and an internal aperture with an internal periphery;

a breathable interface material occupying the internal aperture and attached to the internal periphery of the frame, the breathable interface material comprising:

an upper sheet having an upper plurality of apertures formed therethrough;

a lower sheet spaced from the upper sheet; and a resiliently deformable intermediate layer disposed between the upper sheet and the lower sheet and cooperating with the upper and lower sheets to define a volume of the breathable interface material, whereby the breathable interface material is operable to facilitate air flow from the upper sheet through and around the volume; and a lower frame having an inner peripheral portion which is welded to the sidewall at or near a connection between the second sheet and the sidewall, and an outer peripheral portion welded to an interior surface of the sidewall at an upper junction such that the lower frame and the sidewall cooperate to form a lower corner pocket extending around the periphery of the air mattress.

* * * * *